US008986067B1

(12) United States Patent
Kwan

(10) Patent No.: US 8,986,067 B1
(45) Date of Patent: Mar. 24, 2015

(54) FACIAL EXPRESSION MECHANISM FOR A DOLL

(71) Applicant: Stephanie Kwan, Oakland, CA (US)

(72) Inventor: Stephanie Kwan, Oakland, CA (US)

( * ) Notice: Subject to any disclaimer, the term of this patent is extended or adjusted under 35 U.S.C. 154(b) by 84 days.

(21) Appl. No.: 13/862,355

(22) Filed: Apr. 12, 2013

Related U.S. Application Data

(60) Provisional application No. 61/644,715, filed on May 9, 2012.

(51) Int. Cl.
*A63H 3/36* (2006.01)

(52) U.S. Cl.
CPC ..... *A63H 3/365* (2013.01)
USPC ..... 446/337

(58) Field of Classification Search
CPC ..... A63H 3/36; A63H 3/365; A63H 3/44; A63H 3/48
USPC ..... 446/147, 149, 151, 337, 339, 391, 395
See application file for complete search history.

(56) References Cited

U.S. PATENT DOCUMENTS

| | | | | | |
|---|---|---|---|---|---|
| 2,486,981 | A | * | 11/1949 | Rosenthal | 446/147 |
| 3,014,309 | A | * | 12/1961 | Carroll | 446/341 |
| 3,180,054 | A | * | 4/1965 | Knott | 446/337 |
| 3,210,884 | A | * | 10/1965 | Sharff et al. | 446/100 |
| 3,839,821 | A | * | 10/1974 | Forsman | 446/28 |
| 4,698,927 | A | * | 10/1987 | Yoshiro | 40/1.6 |
| 4,798,556 | A | * | 1/1989 | Vicars et al. | 446/391 |
| 5,178,574 | A | * | 1/1993 | Evoy | 446/372 |
| 5,215,493 | A | | 6/1993 | Zgrodek et al. | |
| 5,498,189 | A | * | 3/1996 | Townsend | 446/100 |
| 5,862,615 | A | * | 1/1999 | O'Rourke | 40/1.6 |
| 6,186,859 | B1 | * | 2/2001 | Hickman et al. | 446/329 |
| 6,419,493 | B1 | * | 7/2002 | Cole | 434/81 |
| 6,923,707 | B2 | | 8/2005 | Dancer | |

* cited by examiner

*Primary Examiner* — Kurt Fernstrom
(74) *Attorney, Agent, or Firm* — Kwan & Olynick LLP

(57) ABSTRACT

Various embodiments of the present invention describe an expression mechanism that can be used to display facial expressions for a doll. This facial expression mechanism can be used with a wide array of toys, including dolls and other items that include a face. The facial expression mechanism includes a flexible cord that can be adjusted to form various shapes that represent different emotions of a doll.

20 Claims, 9 Drawing Sheets

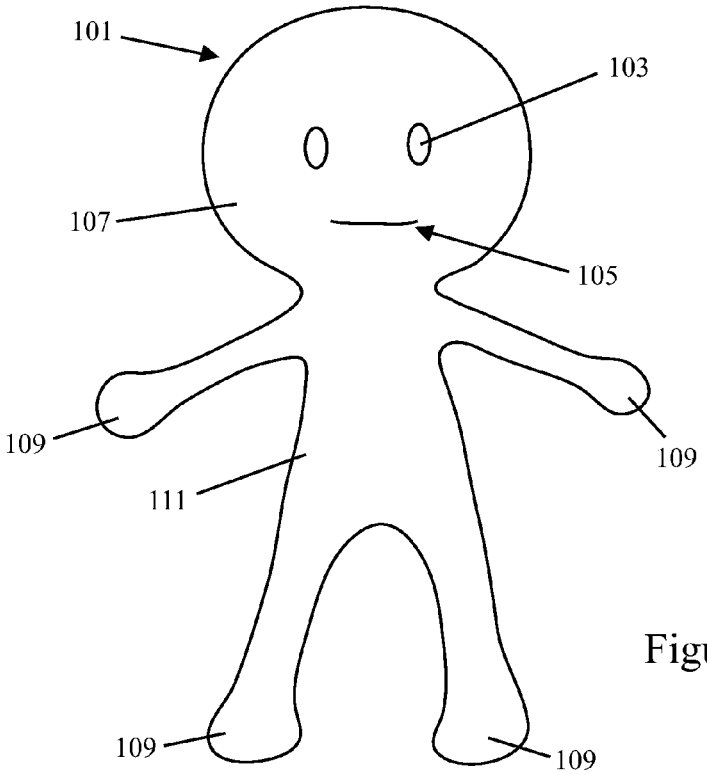
Figure 1A
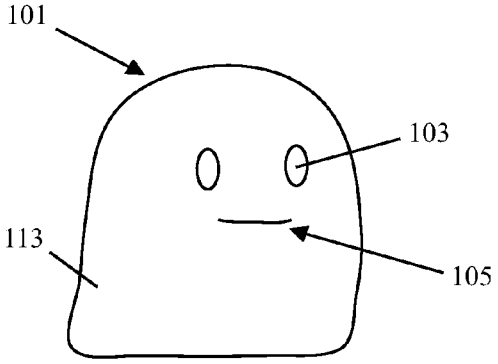
Figure 1B
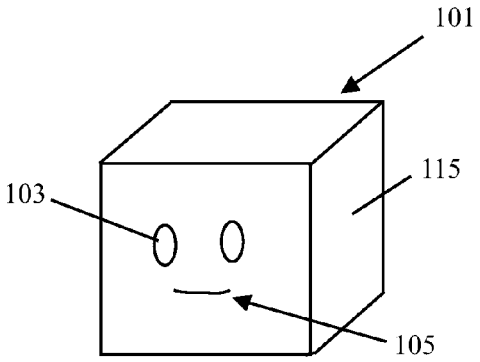
Figure 1C
Figure 1

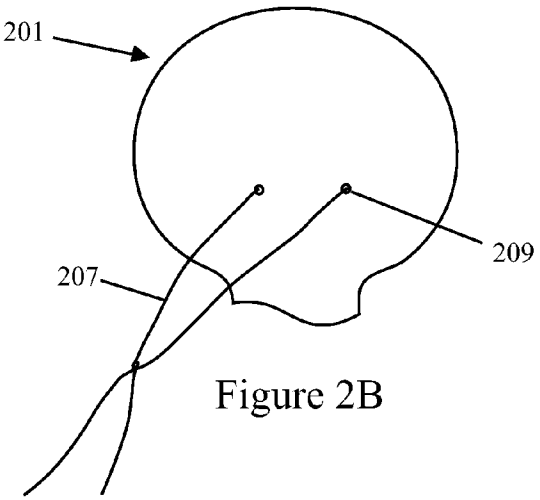
Figure 2B
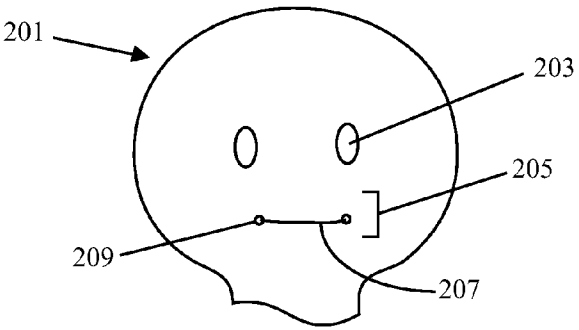
Figure 2A
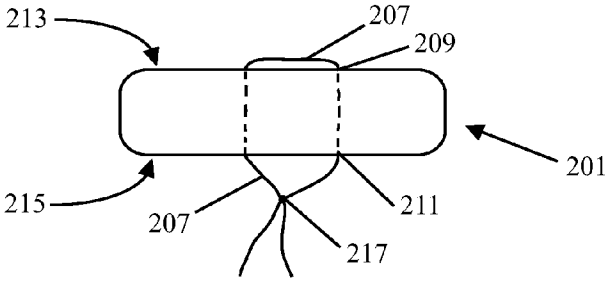
Figure 2C
Figure 2

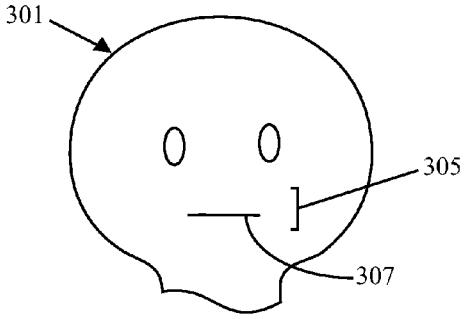
Figure 3A
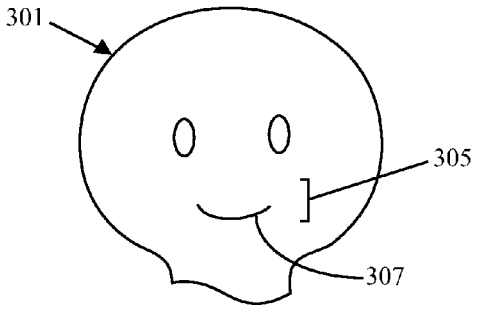
Figure 3B
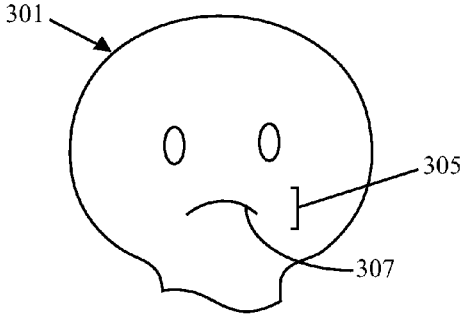
Figure 3C
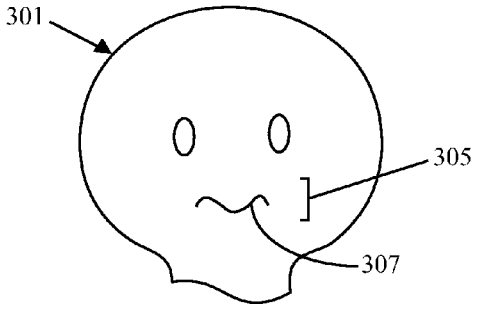
Figure 3D
Figure 3

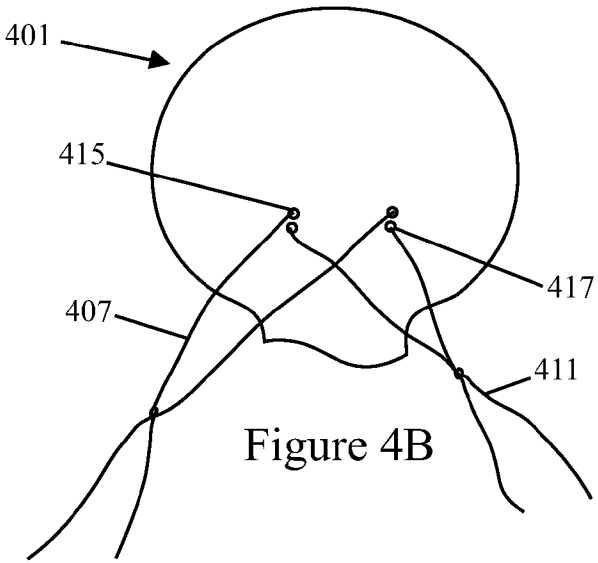
Figure 4B
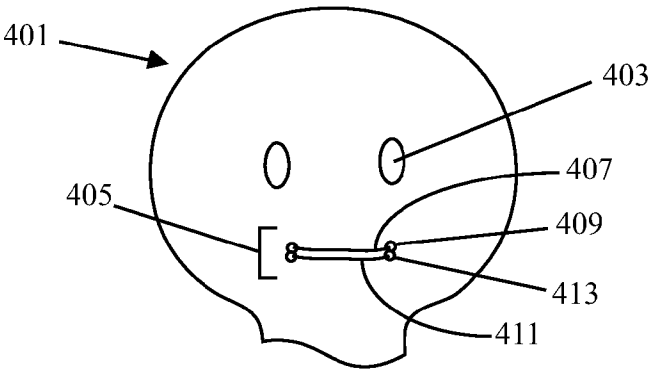
Figure 4A
Figure 4

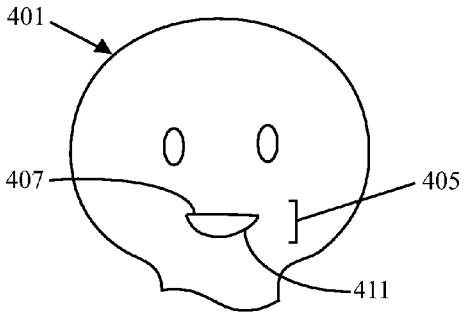
Figure 5A
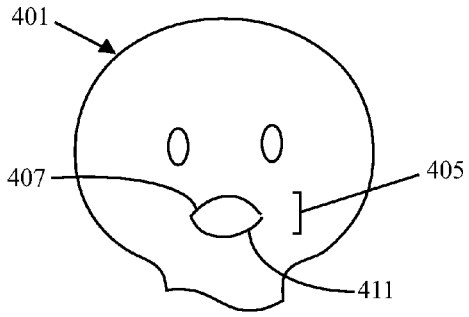
Figure 5B
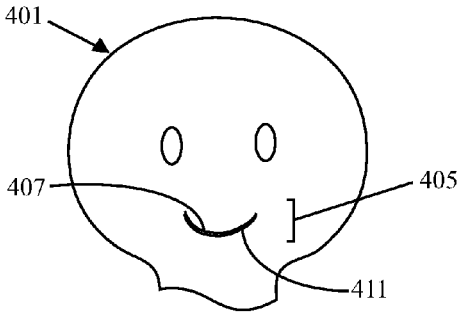
Figure 5C
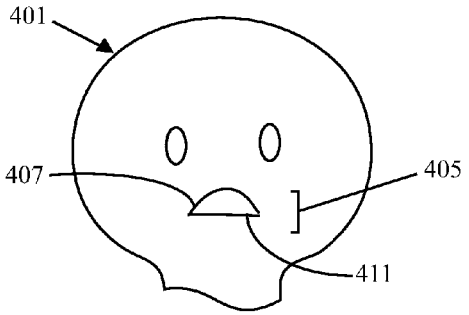
Figure 5D
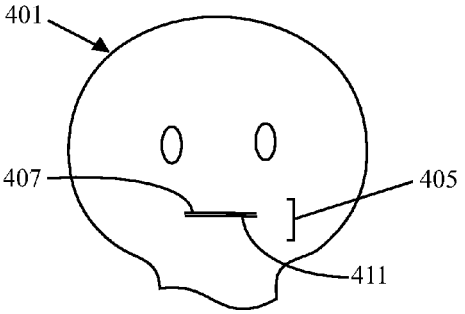
Figure 5E
Figure 5

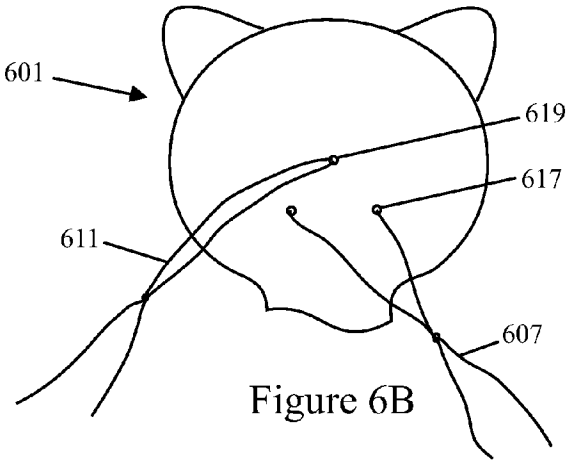
Figure 6B
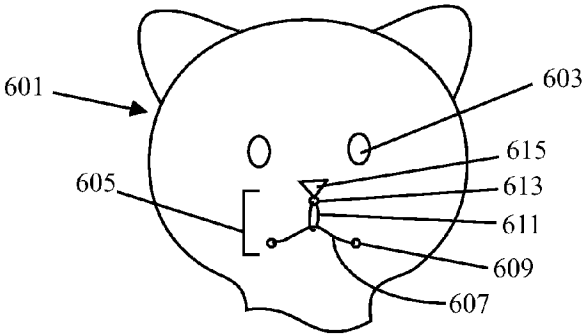
Figure 6A
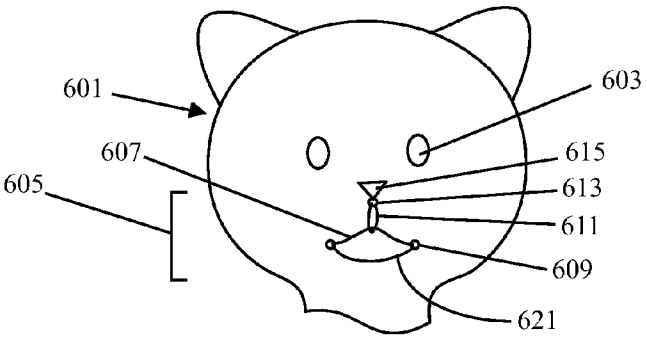
Figure 6C
Figure 6

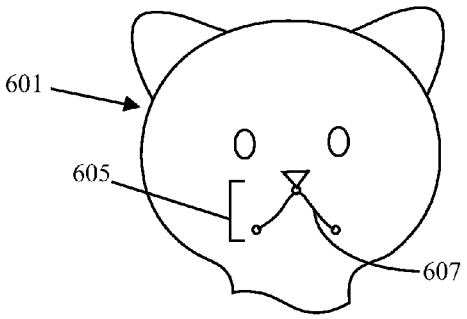
Figure 7A
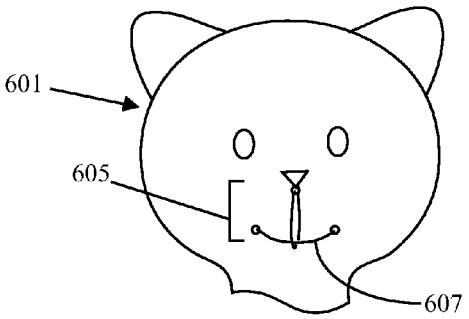
Figure 7B
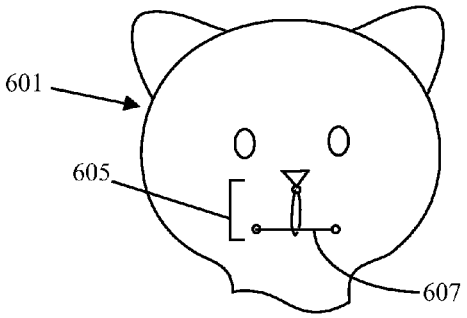
Figure 7C
Figure 7

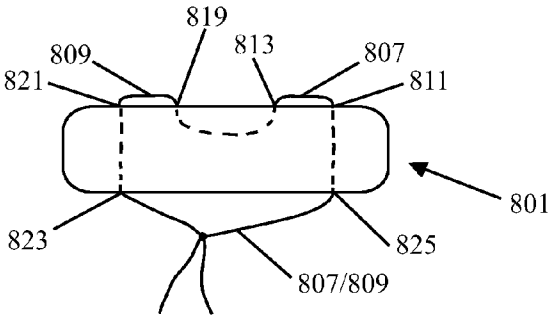
Figure 8B
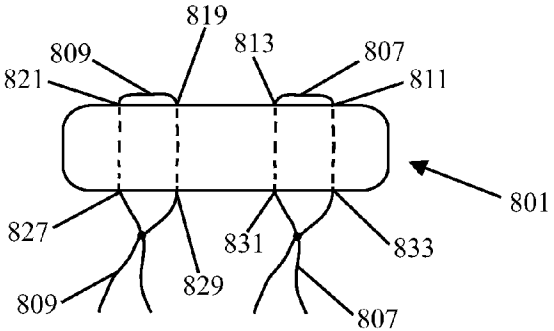
Figure 8C
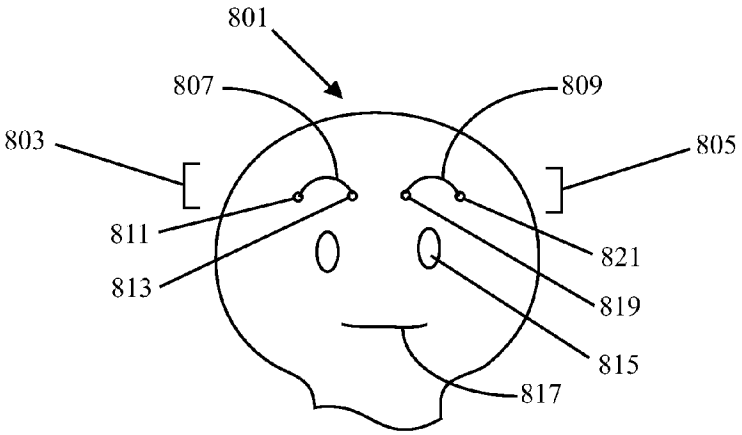
Figure 8A
Figure 8

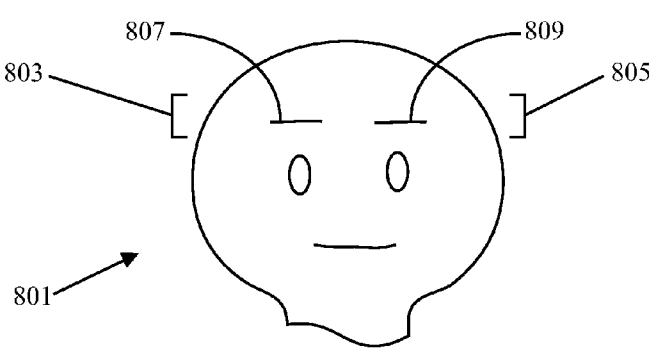
Figure 9A
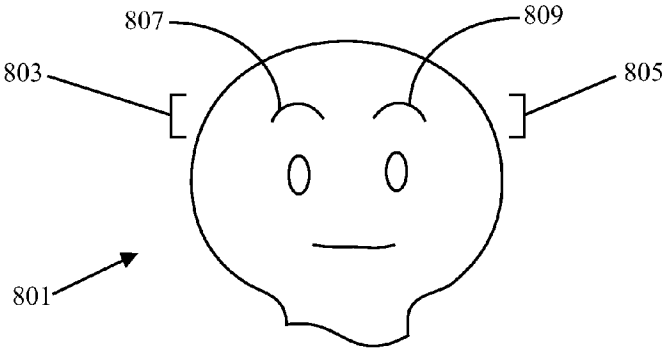
Figure 9B
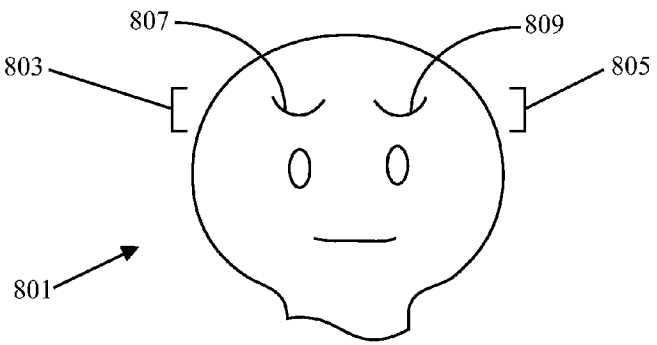
Figure 9C
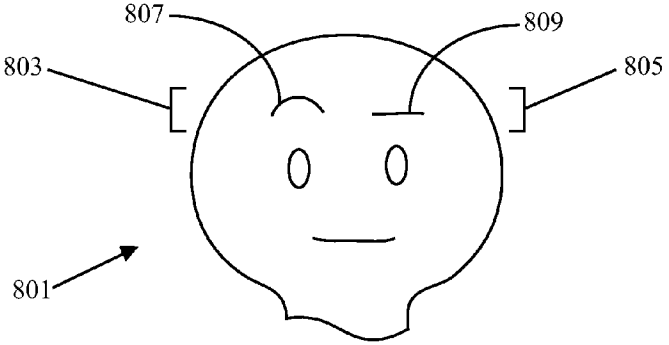
Figure 9D
Figure 9

FACIAL EXPRESSION MECHANISM FOR A DOLL

CROSS-REFERENCE TO RELATED APPLICATIONS

This application claims priority under 35 U.S.C. §119 of prior U.S. Provisional Application No. 61/644,715, filed May 9, 2012, titled "FACIAL EXPRESSION MECHANISM FOR A DOLL" by Stephanie Kwan, which application is herein incorporated by reference in its entirety for all purposes.

TECHNICAL FIELD

The present disclosure relates to dolls, particularly dolls that include a facial expression mechanism.

DESCRIPTION OF RELATED ART

Dolls, such as plush toys, rigid or poseable figures, wooden characters, and the like, continue to be popular for play and display by both children and adults. The ability to provide a doll with personality and expressions is a valuable feature that can enhance the enjoyment and functionality of the doll. Although some dolls include features that can add personality, such as moveable or poseable bodies, moving eyes, and/or hair that can be styled, there is a dearth of dolls or figure toys that have facial features that can be manipulated to convey changeable emotions or expressions of the doll. Consequently, it is desirable to provide improved mechanisms for displaying facial expressions for dolls.

SUMMARY

Various embodiments of the present invention describe an expression mechanism that can be used to display facial expressions for a doll. This facial expression mechanism can be used with a wide array of toys, including dolls and other items that include a face. The facial expression mechanism includes a flexible cord that can be adjusted to form various shapes that represent different emotions of a doll.

BRIEF DESCRIPTION OF THE DRAWINGS

The disclosure may best be understood by reference to the following description taken in conjunction with the accompanying drawings, which illustrate particular embodiments of the present invention.

FIG. 1 illustrates examples of dolls that can be used with the present invention.

FIGS. 2A-2C illustrate a particular example of an expression mechanism that can be used with a doll.

FIGS. 3A-3D illustrate some examples of expressions that can be achieved with an expression mechanism.

FIGS. 4A and 4B illustrate another example of an expression mechanism that can be used with a doll.

FIGS. 5A-5E illustrate examples of expressions that can be achieved with an expression mechanism.

FIGS. 6A-6C illustrate other examples of expression mechanisms that can be used with a doll.

FIGS. 7A-7C illustrate examples of expressions that can be achieved with an expression mechanism.

FIGS. 8A-8C illustrate additional examples of expression mechanisms that can be used with a doll.

FIGS. 9A-9D illustrate some examples of expressions that can be achieved with an expression mechanism.

DETAILED DESCRIPTION

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Dolls, such as plush toys, rigid or poseable figures, wooden characters, and the like, continue to be popular for play and display by both children and adults. The ability to provide a doll with personality and expressions is a valuable feature that can enhance the enjoyment and functionality of the doll. Although many dolls include features that can give personality to a doll, such as moveable or poseable bodies, moving eyes, and/or hair that can be styled, there is a dearth of dolls or figure toys that have facial features that can be manipulated to convey changeable emotions or expressions of the doll. Consequently, it is desirable to provide improved mechanisms for displaying facial expressions for dolls.

Consequently, the techniques and mechanisms of the present invention provide an expression mechanism that can be used to display facial expressions for a doll. This facial expression mechanism can be used with a wide array of toys, including dolls and anything else that includes a face. Dolls featuring such facial expression mechanisms can be used by children for pretend play, by children on the autism spectrum who are trying to learn about and convey emotions, and by children undergoing therapy (such as psychological counseling). Furthermore, dolls with a facial expression mechanism can be used by adult therapists and professionals in various fields to help children with emotional or social issues. In addition, adult collectors may find dolls with facial expression mechanisms particularly appealing for photography and storytelling through photos (such as through pic fics).

FIG. 1 provides some examples of dolls that can be used with the present invention. With reference to FIG. 1A, shown is a doll 101 that includes a head 107, torso 111, and limbs 109. As shown, the doll includes facial features. These facial features include eyes 103 and mouth 105. The doll 101 as shown resembles a human or anthropomorphic figure, and but can also take the form of a fantasy character with any number of heads 107, eyes 103, mouths 105, noses, ears, limbs 109, torsos 111, or other body or facial features. For instance, a doll could be a two-headed octopus with one eye. In another example, a doll could be a Siamese twin connected at two limbs, such that it has two torsos, two heads, and various limbs.

With reference to FIGS. 1B and 1C, shown are other examples of dolls 101 that can be used with the present invention. In FIG. 1B, shown is an example of a doll 101 with a body 113 and facial features such as eyes 103 and mouth 105. Such a doll could be made into a plush, a pillow, a plastic figure, etc. It could also take the form of a paper doll or paper craft figure. In FIG. 1C, shown is another example of a doll 101 with a body 115 and facial features such as eyes 103 and mouth 105. In this example, the doll can also be made into a plush, a pillow, a plastic figure, etc. It could also take the form of a paper doll or paper craft figure. With respect to the present invention, the term "doll" is intended to be broadly defined to include figure toys, plush toys, pillows, paper dolls, action figures etc., or any item that includes a facial feature. It should be noted that the examples shown in FIG. 1 are intended to be illustrative and not limiting.

As contemplated by the present invention, a doll can be made from any of a myriad of materials. For instance, the doll can be a plush figure, made from cloth and filling. In some examples the plush figure can include a wire frame or skeleton of some kind to make the doll either more rigid or poseable. In other examples, the doll can be made of a more firm material such as plastic, vinyl, wood, resin, cardboard, etc. that is either solid or hollow. In some examples, a doll can be made from paper, as with traditional paper dolls, or cardboard. FIG. 2 illustrates a particular example of an expression mechanism that can be used with a doll. With reference to FIG. 2A, shown is a front view of a doll 201 with facial features that include eyes 203 and an expression mechanism 205. Manufacturing a doll may include attaching the expression mechanism onto the doll. The expression mechanism includes a flexible cord 207 that is threaded through front openings 209. FIG. 2B includes a back view of the doll 201, and shows flexible cord 207 emerging from back openings 211. A top view of the doll 201 is shown in FIG. 2C. As shown, flexible cord 207 passes through the doll from the front 213 of the doll to the back 215 of the doll through front openings 209 and back openings 211, respectively. In this particular embodiment, the flexible cord includes a knot 217 on the back side of the doll. This knot 217 can be used to secure the ends of the flexible cord 207, and can also provide a grip to pull the flexible cord 207. However it should be noted that the cord does not need to include a knot 217 and can either be a continuous cord or can include separate knots on each of the ends, etc.

The expression mechanism shown in the particular embodiment of FIG. 2 is used to indicate the mouth of the doll. The flexible cord 207 can be pulled and formed at the front of the doll to create expressions. The portion of the flexible cord 207 that is visible from the back 215 of the doll can be pulled to "reset" the expression and/or create the desired amount of slack or play in the flexible cord 207 visible from the front side 213 of the doll. For instance, if flexible cord 207 is pulled taught, the visible portion of the cord on the front side 213 of the doll can form a straight line. If the flexible cord 207 is then manipulated from the front side 213, it can be pulled and formed to create a smile, frown, or other desired expression.

It should be noted that although the present embodiment describes flexible cord 207 emerging from two openings on the back of the doll, the flexible cord can emerge from a single opening in some embodiments. In particular, both ends of the flexible cord can be threaded through a single opening.

It should also be noted that although the present embodiment shows flexible cord 207 emerging from the back of the doll through openings 211, it should be noted that flexible cord 207 need not emerge from the back or any other side of the doll in some embodiments. For instance, if the doll 201 is hollow or plush, the present embodiment shows flexible cord 207 passing through the exterior surface of the doll's face (front side of the doll) through openings 209, through the interior surface of the doll's face through openings 209, through the interior surface of the back of the doll's head through openings 211, and through the exterior surface of the back of the doll's head through openings 211. However, in an alternative embodiment, flexible cord 207 can pass through the exterior surface of the doll's face (front side of the doll) through openings 209, through the interior surface of the doll's face through openings 209, and attach to another mechanism that emerges from the back side of the doll. For instance, an adjustment mechanism such as a rod, stick, lever, tab, another flexible cord, etc. can be tied or otherwise attached to the flexible cord 207 within the doll's head and this can be exposed at the back side of the doll. In some examples, the flexible cord itself can be combined within the doll's head and can emerge as an adjustment mechanism. In yet other examples, the adjustment mechanism can include multiple parts, such as a ring that the flexible cord can be tied or otherwise attached to, and another cord or rigid member attached to this ring. This other cord or rigid member can be exposed at the back side of the doll, while the ring remains within the interior of the doll. An adjustment mechanism can be used from the back side of the doll to "reset" the expression mechanism into a neutral position. In addition, although the adjustment mechanism and/or exposed flexible cord used to adjust the expression is located at the back of the doll in the present examples, it may be located on any surface of the doll, such as a side, etc. within the scope of the present invention.

In the present embodiment, the doll 201 can be made of any of a myriad of materials. For instance, the doll 201 can be a plush toy made from fabric and stuffed with a filling, a solid or hollow plastic material, vinyl material, resin, rubber or other flexible material, wood, paper, cardboard, metal, acetate, plastic sheeting, etc. The doll 201 can be any shape or form and can be made in any size. Furthermore, the doll 201 can have any number of facial features. The flexible cord 207 can be made from any of a myriad of materials, such as string, ribbon, embroidery floss, wire (including coated wire), thread, laces/lacing, chain, etc. These materials can include fabric/fibrous materials, textiles, metal, rubber/plastic, or the like. Some of the materials will hold their shape on their own (e.g. wire), while others may use friction with the front of the doll to keep their shape (e.g. thread, string). In addition, depending on the materials used, the manner in which openings 209 and 211 are formed may vary. For instance, with a fabric doll, the openings may be the holes created as a string is threaded through the fabric. In another example, with a vinyl doll, tiny holes or slits may be formed in the vinyl and then the string can be threaded through these holes/slits.

FIGS. 3A-3D illustrate some examples of expressions that can be achieved with an expression mechanism as contemplated in FIG. 2. In FIG. 3A, shown is a doll 301 with an expression mechanism 305 that has been manipulated to represent a mouth in a neutral position. In order to achieve this neutral position, flexible cord 307 has been pulled from the back of the doll so that it is taught in the front of the doll. With reference to the example shown in FIG. 3B, shown is a doll 301 with an expression mechanism 305 that has been manipulated to depict a smile with flexible cord 307. In FIG. 3C, shown is a doll 301 with an expression mechanism 305 that has been manipulated to depict a frown with flexible cord 307. In FIG. 3D, shown is a doll 301 with an expression mechanism 305 that has been manipulated to depict a wiggly mouth with flexible cord 307. Similarly, other expressions can be formed as desired, limited only by the imagination of the person interacting with the doll. The expression mechanism can be "reset" from any of the expressions by returning the expression mechanism to a neutral position as shown in FIG. 3A.

FIG. 4 illustrates another example of an expression mechanism that can be used with a doll. With reference to FIG. 4A, shown is a front view of a doll 401 with facial features that include eyes 403 and an expression mechanism 405. Manufacturing a doll may include attaching the expression mechanism onto the doll. The expression mechanism includes a flexible cord 407 that is threaded through front openings 409, and separate flexible cord 411 that is threaded through front openings 413. FIG. 4B includes a back view of the doll 401, and shows flexible cord 407 emerging from back openings 415, and flexible cord 411 emerging through back openings 417. In this particular embodiment, flexible cords 407 and 411 each include a knot. This knot can be used to secure the ends of the flexible cords, and can also provide a grip to pull them. However it should be noted that the cord does not need to include a knot and can either be a continuous cord or can include separate knots at the ends of the cords, etc. in some examples. In some embodiments, the portion of the flexible cords below the knot can be braided, knotted, beaded, etc. Also, in some embodiments, a charm (e.g. pull charm), ring (e.g. pull ring), bead, or other item(s) can be attached to the end of the flexible cord in order to serve as a tab or grip that can be held when the flexible cord is pulled. In addition, such charms, rings, beads, or other item(s) can add to a doll owner's enjoyment because these items can be selected to personalize the doll.

It should be noted that although openings 415 are located above openings 417 in FIG. 4B, the placement of openings 415 and 417 can be reversed without deviating from the scope of this invention. In addition, although openings 409 and 413 are shown as separate openings in the present embodiment, openings 409 and 413 can be combined in some embodiments such that cords 407 and 411 can pass through the same openings. Similarly, back openings 415 and 417 can be combined in some embodiments so that cords 407 and 411 pass through the same openings. Alternatively, both ends of cord 407 can pass through a single opening at the back of the doll and both ends of flexible cord 411 can pass through another opening at the back of the doll.

The expression mechanism shown in the particular embodiment of FIG. 4 is used to indicate the mouth of the doll 401. The flexible cords 407 and 411 can be pulled and formed from the front of the doll to create expressions. In particular, flexible cords 407 and 411 can be manipulated from the front side of doll 401 and formed to create a smile, frown, yell, or other desired expression. The portion of the flexible cords 407 and 411 that is visible from the back of the doll can be pulled to "reset" the expression and/or create the desired amount of slack or play in the portion of the flexible cords visible from the front side of the doll 401. For instance, if flexible cords 407 and 411 are both pulled taught, the visible portion of the cord on the front side of the doll can form a straight line or neutral expression.

It should be noted that although the present embodiment includes two flexible cords as part of the expression mechanism, any number of flexible cords can be included in the expression mechanism without deviating from the spirit and scope of this invention. Furthermore, the placement of the flexible cords can vary with respect to one another. In the present embodiment, the two flexible cords are parallel to each other and each flexible cord has the same distance between the front openings (so that the same amount of flexible cord is visible from the front of the doll when both cords are pulled into a neutral position.) However, it should be recognized that two or more flexible cords can be placed in non-parallel placement with respect to each other and/or can have different lengths between the front openings. For example, the top flexible cord can be longer than the bottom flexible cord when both flexible cords are pulled taught into a neutral position.

Although the present embodiment shows flexible cords 407 and 411 emerging from the back of the doll through openings 415 and 417, respectively, it should be noted that flexible cords 407 and 411 need not emerge from the back or any other side of the doll in some embodiments. For instance, if the doll 401 is hollow or plush, the present embodiment shows flexible cords 407 and 411 passing through the exterior surface of the doll's face (front side of the doll) through openings 409 and 413, respectively, through the interior surface of the doll's face through openings 409 and 413, respectively, through the interior surface of the back of the doll's head through openings 415 and 417, respectively, and through the exterior surface of the back of the doll's head through openings 415 and 417, respectively. However, in an alternative embodiment, flexible cords 407 and 411 can pass through the exterior surface of the doll's face (front side of the doll) through openings 409 and 413, respectively, through the interior surface of the doll's face through openings 409 and 413, respectively, and each attach to separate mechanisms that emerge from the back side of the doll. For instance, an adjustment mechanism such as a rod, stick, lever, tab, another flexible cord, etc. can be tied or otherwise attached to the flexible cord 407 within the doll's head and this adjustment mechanism can be exposed at the back side of the doll. Similarly, an adjustment mechanism can be tied or otherwise attached to flexible cord 411 within the doll's head and this adjustment mechanism can also be exposed at the back side of the doll. In some examples, the flexible cord itself can be combined within the doll's head and can emerge as an adjustment mechanism. In yet other examples, the adjustment mechanism can include multiple parts, such as a ring that the flexible cord can be tied or otherwise attached to, and another cord or rigid member attached to this ring. This other cord or rigid member can be exposed at the back side of the doll, while the ring remains within the interior of the doll. These adjustment mechanisms can be used from the back side of the doll to "reset" the expression mechanism into a neutral position. In addition, although the adjustment mechanism and/or exposed flexible cord used to adjust the expression is located at the back of the doll in the present examples, it may be located on any surface of the doll, such as a side, etc. within the scope of the present invention.

In the present embodiment, the doll 401 can be made of any of a myriad of materials, as previously described with respect to the doll described in FIG. 2. Furthermore, like the doll in FIG. 2, the doll 401 of the present embodiment can take any shape or form and can be made in any size. Furthermore, the doll 201 can have any number of facial features, such as eye(s), mouth(s), nose(s), etc.

Additionally, as with the example described in conjunction with FIG. 2, the flexible cords 407 and 411 can be made from any of a myriad of materials. In addition, depending on the materials used, the manner in which openings 409 and 413 are formed may vary. For instance, with a fabric doll, the openings may be the holes created as a string is threaded through the fabric. In another example, with a vinyl doll, tiny holes or slits may be formed in the vinyl and then the string can be threaded through these holes/slits. For more details and examples of materials that can be used for doll 401 and flexible cords 407 and 411, please refer to the description above with regard to FIG. 2.

FIGS. 5A-5E depict some examples of expressions that can be achieved with an expression mechanism as contemplated in FIG. 4. In FIG. 5A, shown is a doll 401 with an expression mechanism 405 that has been manipulated to represent a mouth in an open-mouth smiling position. In order to achieve this position from a neutral starting position, flexible cord 407 has been pulled from the back of the doll so that it is taught in the front of the doll, and flexible cord 411 has been pulled from the front of the doll and formed into this smiling position. In FIG. 5B, shown is a doll 401 with an expression mechanism 405 that has been manipulated to represent a mouth with a surprised/yelling/open-mouth expression. In order to achieve this position from a neutral starting position, flexible cords 407 and 411 have been pulled from the front of the doll and each formed into their respective positions. In FIG. 5C, shown is a doll 401 with an expression mechanism 405 that has been manipulated to represent a mouth in a smiling position. In order to achieve this position from a neutral starting position, flexible cords 407 and 411 have both been pulled from the front of the doll and together formed into this smiling shape. In FIG. 5D, shown is a doll 401 with an expression mechanism 405 that has been manipulated to represent a mouth in an open-mouth frown position. In order to achieve this position from a neutral starting position, flexible cord 407 has been pulled from the front of the doll and formed into this frowning position, and flexible cord 411 has been pulled from the back of the doll so that it is taught in the front of the doll. In FIG. 5E, shown is a doll 301 with an expression mechanism 405 that has been manipulated to represent a mouth in a neutral position. In order to achieve this neutral position, flexible cords 407 and 411 have both been pulled from the back of the doll so that they are taught in the front of the doll.

It should be noted that although FIGS. 5A-5E show particular examples of expressions that can be achieved with expression mechanism 405, other expressions can also be formed as desired, limited only by the imagination of the person interacting with the doll. The expression mechanism 405 can be "reset" from any of the expressions by returning the expression mechanism to a neutral position as shown in FIG. 5E.

FIGS. 6A-6C illustrate other examples of expression mechanisms that can be used with a doll. With reference to FIG. 6A, shown is a front view of a doll 601 with facial features that include eyes 603, nose 615, and expression mechanism 605. Manufacturing a doll may include attaching the expression mechanism onto the doll. The expression mechanism includes a flexible cord 607 that is threaded through front openings 609, and separate flexible cord 611 that is looped around flexible cord 607 and threaded through front opening(s) 613. In some embodiments, flexible cord 611 can be tied, knotted, or otherwise attached to flexible cord 607. Furthermore, although flexible cord 611 is shown with two ends threaded through front opening(s) 613, in some embodiments only one end may be threaded through front opening 613 (such as when the other end is tied to or otherwise attached to flexible cord 607).

FIG. 6B includes a back view of the doll 601, and shows flexible cord 607 emerging from back openings 617, and flexible cord 611 emerging through back opening(s) 619. In this particular embodiment, flexible cords 607 and 611 each include a knot. This knot can be used to secure the ends of the flexible cords, and can also provide a grip to pull them. However it should be noted that the cord does not need to include a knot and can either be a continuous cord or can include separate knots, etc. in some examples. In some embodiments, the portion of the flexible cords below the knot can be braided, knotted, beaded, etc. Also, in some embodiments, a charm (e.g. pull charm), ring (e.g. pull ring), bead, or other item(s) can be attached to the end of the flexible cord in order to serve as a tab or grip that can be held when the flexible cord is pulled. In addition, such charms, rings, beads, or other item(s) can add to a doll owner's enjoyment because these items can be selected to personalize the doll.

The expression mechanism shown in the particular embodiment of FIG. 6 is used to indicate the mouth of the doll 601, and the doll 601 resembles a cat. The flexible cords 607 and 611 can be pulled and formed at the front of the doll to create expressions. In particular, flexible cords 607 and 611 can be manipulated on the front side of doll 601 and formed to create a smile, frown, or other desired expression. The portion of the flexible cords 607 and 611 that is visible from the back of the doll can be pulled to "reset" the expression and/or create the desired amount of slack or play in the portion of the flexible cords visible on the front side of the doll 601.

It should be noted that although the present embodiment includes two flexible cords as part of the expression mechanism, any number of flexible cords can be included in the expression mechanism without deviating from the spirit and scope of this invention. For instance, with reference to FIG. 6C, shown is an expression mechanism with three flexible cords 607, 611, and 621. Additional flexible cord 621 is threaded through openings 609 (or through separate openings near 609). In this alternative embodiment, additional expressions can be achieved such as the talking/yelling/meowing expression shown.

With respect to the embodiments of FIGS. 6A-6C, the placement of the flexible cords can vary with respect to one another. In the present embodiment, the two flexible cords 607 and 611 are perpendicular to each other. Furthermore, in FIG. 6C, flexible cords 607 and 621 are parallel to each other. However, the flexible cords and the associated openings can be positioned differently to create different looks and characteristics for the doll. For instance, one of the openings 609 can be placed higher than the other to give the doll a slanted mouth. It should be noted that although the present embodiment describes flexible cord 607 emerging from two openings on the back of the doll, the flexible cord can emerge from a single opening in some embodiments. In particular, both ends of the flexible cord can be threaded through a single opening. Furthermore, it is possible for flexible cord 611 to pass through the same opening as cord 607 in some examples.

Although the present embodiment shows flexible cords 607 and 611 emerging from the back of the doll through openings, it should be noted that the flexible cords need not emerge from the back or any other side of the doll in some embodiments. Like the alternative embodiments described above with respect to FIGS. 2 and 4, an adjustment mechanism such as a rod, stick, lever, tab, another flexible cord, etc. can be tied or otherwise attached to a flexible cord within the doll's head and this can be exposed at the back side of the doll. As described above, the flexible cord itself can be combined within the doll's head and can emerge as an adjustment mechanism in some examples. In yet other examples, the adjustment mechanism can include multiple parts, such as a ring that the flexible cord can be tied or otherwise attached to, and another cord or rigid member attached to this ring. This other cord or rigid member can be exposed at the back side of the doll, while the ring remains within the interior of the doll. The adjustment mechanism can be used from the back side of the doll to "reset" the expression mechanism into a neutral position. In addition, although the adjustment mechanism and/or exposed flexible cord used to adjust the expression is located at the back of the doll in the present examples, it may be located on any surface of the doll, such as a side, etc. within the scope of the present invention.

In the present embodiment, the doll 601 can be made of any of a myriad of materials, as previously described with respect to the doll described in FIG. 2. Furthermore, like the doll in FIG. 2, the doll 601 of the present embodiment can take any shape or form and can be made in any size. Although the expression mechanism 605 is used with a doll representing a cat in the present embodiment, it should be recognized that this expression mechanism 605 can be used with any other doll, animal, fantasy, character, figure, etc.

Additionally, as with the example described in conjunction with FIG. 2, the flexible cords 607, 611, and 621 can be made from any of a myriad of materials. In addition, depending on the materials used, the manner in which openings 609 and 613 are formed may vary. For instance, with a fabric doll, the openings may be the holes created as a string is threaded through the fabric. In another example, with a vinyl doll, tiny holes or slits may be formed in the vinyl and then the string can be threaded through these holes/slits. For more details and examples of materials that can be used for doll 601 and flexible cords 607 and 611, please refer to the description above with regard to FIG. 2, etc.

FIGS. 7A-7C illustrate examples of expressions that can be achieved with the expression mechanism depicted in FIGS. 6A-6B. In FIG. 6A, shown is a doll 601 with an expression mechanism 605 that has been manipulated to represent a mouth in a frowning or reverse-V position. In order to achieve this position, flexible cord 607 has been pulled from the back of the doll so that it is taught in the front of the doll, and flexible cord 611 has been pulled from the back of the doll so that it is taught and does not show from the front of the doll. In particular, flexible cord 611 serves to pull flexible cord 607 into the position shown. In FIG. 7B, shown is a doll 601 with an expression mechanism 605 that has been manipulated to represent a mouth in a smiling position. In order to achieve this position, flexible cords 607 and 611 have both been pulled downwards from the front side of the doll and formed into the position shown. In FIG. 7C, shown is a doll 601 with an expression mechanism 605 that has been manipulated to represent a mouth in a neutral position. In order to achieve this position, flexible cords 407 and 411 have both been pulled taught from the back of the doll and adjusted at the front of the doll to achieve this particular configuration.

It should be noted that although FIGS. 7A-7C show particular examples of expressions that can be achieved with expression mechanism 605, other expressions can also be formed as desired, limited only by the imagination of the person interacting with the doll.

FIGS. 8A-8C illustrate another example of an expression mechanism that can be used with a doll. With reference to FIG. 8A, shown is a front view of a doll 801 with expression mechanisms 803 and 805, eyes 815, and mouth 817. Manufacturing a doll may include attaching the expression mechanisms onto the doll. Expression mechanism 803 includes a flexible cord 807 that is threaded through front openings 811 and 813, and expression mechanism 805 includes a flexible cord 809 that is threaded through front openings 819 and 821. As shown, expression mechanisms 803 and 805 represent eyebrows on the face of doll 801. These expression mechanisms 803 and 805 can be configured in different ways, as shown in the alternative embodiments of FIGS. 8B and 8C.

With reference to FIG. 8B, shown is a top view of doll 801 in which flexible cord 807 and flexible cord 809 are each part of the same flexible cord. In particular, flexible cord 807/809 is shown threaded through front openings 811, 813, 819, and 821 on the front of the doll, and emerging through back openings 823 and 825 on the back of the doll. In this particular embodiment, flexible cord 807/809 includes a knot. This knot can be used to secure the ends of the flexible cords, and can also provide a grip to pull them. However it should be noted that the cord does not need to include a knot and can either be a continuous cord or can include separate knots at the ends of the cord, etc. in some examples. In some embodiments, the portion of the flexible cords below the knot can be braided, knotted, beaded, etc. Also, in some embodiments, a charm (e.g. pull charm), ring (e.g. pull ring), bead, or other item(s) can be attached to the end of the flexible cord in order to serve as a tab or grip that can be held when the flexible cord is pulled. In addition, such charms, rings, beads, or other item(s) can add to a doll owner's enjoyment because these items can be selected to personalize the doll. With reference to FIG. 8C, shown is an alternative embodiment for expression mechanisms 803 and 805. In this alternative embodiment, shown is a top view of doll 801 in which flexible cord 807 and flexible cord 809 are part of separate flexible cords. In particular, flexible cord 807 is shown threaded through front openings 811 and 813 on the front of the doll, and emerging through back openings 831 and 833 on the back of the doll. Furthermore, flexible cord 809 is shown threaded through front openings 819 and 821 on the front of the doll, and emerging through back openings 827 and 829 on the back of the doll. In this particular embodiment, flexible cords 807 and 809 both include knots, respectively. The knots shown can be used to secure the ends of the flexible cords, and can also provide a grip to pull them. However it should be noted that the cord does not need to include a knot and can either be a continuous cord or can include separate knots at the end of the cord, etc. in some examples. In some embodiments, the portion of the flexible cords below the knot can be braided, knotted, beaded, etc. Also, in some embodiments, a charm (e.g. pull charm), ring (e.g. pull ring), bead, or other item(s) can be attached to the end of the flexible cord in order to serve as a tab or grip that can be held when the flexible cord is pulled. In addition, such charms, rings, beads, or other item(s) can add to a doll owner's enjoyment because these items can be selected to personalize the doll.

The expression mechanisms shown in the particular embodiment of FIG. 8 are used to indicate the eyebrows of the doll 801. The flexible cords 807 and 809 can be pulled and formed at the front of the doll to create various expressions. The portion of the flexible cords 807 and 809 that is visible from the back of the doll can be pulled to "reset" the expression and/or create the desired amount of slack or play in the portion of the flexible cords visible on the front side of the doll 801.

With respect to the present embodiment, the placement of the flexible cords can vary with respect to one another. In the present embodiment, the two flexible cords 807 and 809 are threaded through openings 811, 813, 819, and 821, all of which lie roughly along the same line. However, the flexible cords and the associated openings can be positioned differently to create different looks and characteristics for the doll in other embodiments. For instance, opening 813 can be placed higher than opening 811 (or vice-versa). In another example, both openings 811 and 813 can be placed higher or lower than openings 819 and 821 (such as with a slanted or asymmetric face, or with eyes/eyebrows stacked above/below one another). It should also be noted that although the present embodiment includes two eyebrows as expression mechanisms, any number of eyebrows or expression mechanisms can be included without deviating from the spirit and scope of this invention. For instance, a single eyebrow can be included to depict a unibrow, or three eyebrows might be desired for a three-eyed monster.

It should be noted that although the present embodiment describes flexible cords 807 and 809 emerging from multiple openings on the back of the doll, the flexible cords can emerge from a single opening (or any number of openings) in some embodiments. For instance, with reference to FIG. 8B, both ends of the flexible cord can be threaded through a single opening. With reference to FIG. 8C, opening 827 and 829 can be merged into the same opening. In yet other embodiments, openings 827, 829, 831, and 833 can all be merged into the same opening.

Although the present embodiment shows flexible cords 807 and 809 emerging from the back of the doll through openings, it should be noted that the flexible cords need not emerge from the back or any other side of the doll in some embodiments. Like the alternative embodiments described above with respect to FIGS. 2 and 4, an adjustment mechanism such as a rod, stick, lever, tab, another flexible cord, etc. can be tied or otherwise attached to a flexible cord within the doll's head and this can be exposed at the back side of the doll. As also described above, the flexible cord itself can be combined within the doll's head and can emerge as an adjustment mechanism in some examples. In yet other examples, the adjustment mechanism can include multiple parts, such as a ring that the flexible cord can be tied or otherwise attached to, and another cord or rigid member attached to this ring. This other cord or rigid member can be exposed at the back side of the doll, while the ring remains within the interior of the doll. This adjustment mechanism can be used from the back side of the doll to "reset" the expression mechanism into a neutral position. In addition, although the adjustment mechanism and/or exposed flexible cord used to adjust the expression is located at the back of the doll in the present examples, it may be located on any surface of the doll, such as a side, etc. within the scope of the present invention.

In the present embodiment, the doll 801 can be made of any of a myriad of materials, as previously described with respect to the doll described in FIG. 2. Furthermore, like the doll in FIG. 2, the doll 801 of the present embodiment can take any shape or form and can be made in any size. Additionally, as with the example described in conjunction with FIG. 2, the flexible cords 807 and 809 can be made from any of a myriad of materials. In addition, depending on the materials used, the manner in which openings 811, 813, 819, and 821 are formed may vary. For instance, with a fabric doll, the openings may be the holes created as a string is threaded through the fabric. In another example, with a vinyl doll, tiny holes or slits may be formed in the vinyl and then the string can be threaded through these holes/slits. For more details and examples of materials that can be used for doll 801 and flexible cords 807 and 809, please refer to the description above with regard to FIG. 2.

FIGS. 9A-9D illustrate some examples of expressions that can be achieved with the expression mechanism contemplated in FIG. 8. In FIG. 9A, shown is a doll 801 with expression mechanisms 803 and 805 that have been manipulated to represent eyebrows in a neutral position. In order to achieve this neutral position, flexible cords 807 and 809 have both been pulled from the back of the doll so that they are taught in the front of the doll. In FIG. 9B, shown is a doll 801 with expression mechanisms 803 and 805 that have been manipulated to represent eyebrows with a happy/surprised/attentive expression. In order to achieve this position from a neutral starting position, flexible cords 807 and 809 have each been pulled from the front of the doll and formed into these curved shapes. In FIG. 9C, shown is a doll 801 with expression mechanisms 803 and 805 that have been manipulated to represent eyebrows with a worried/sad/distressed expression. In order to achieve this position from a neutral starting position, flexible cords 807 and 809 have each been pulled from the front of the doll and each formed into these curved positions. In FIG. 9D, shown is a doll 801 with expression mechanisms 803 and 805 that have been manipulated to represent eyebrows in a perplexed/skeptical expression. In order to achieve this position from a neutral starting position, flexible cord 807 has been pulled from the front of the doll and formed into this concave-downward shape. Flexible cord 809 remains in its neutral position by pulling taught the cord from the back of the doll.

It should be noted that although FIGS. 9A-9D show particular examples of expressions that can be achieved with expression mechanisms 803 and 805, other expressions can also be formed as desired, limited only by the imagination of the person interacting with the doll. The expression mechanisms 803 and 805 can be "reset" from any of the expressions by returning the expression mechanism to a neutral position as shown in FIG. 9A.

While the invention has been particularly shown and described with reference to specific embodiments thereof, it will be understood by those skilled in the art that certain changes and modifications of the disclosed embodiments may be made without departing from the spirit or scope of the invention. Accordingly, the present embodiments are to be considered as illustrative and not restrictive and the invention is not to be limited to the details given herein, but may be modified within the scope and equivalents of the appended claims. It is therefore intended that the invention be interpreted to include all variations and equivalents that fall within the true spirit and scope of the present invention.

What is claimed is:

1. A doll comprising:

a facial expression mechanism visible from a first surface of the doll, wherein the facial expression mechanism includes a flexible cord having an adjustable first length visible from the first surface, and wherein the flexible cord passes through two or more openings on the first surface of the doll and emerges through two or more openings on a second surface of the doll.

2. The doll of claim 1, wherein the first surface of the doll is a front exterior of the doll, and the second surface of the doll is a back exterior of the doll.

3. The doll of claim 1, wherein the facial expression mechanism represents a mouth.

4. The doll of claim 1, wherein the facial expression mechanism represents an eyebrow.

5. The doll of claim 1, wherein the doll is hollow.

6. The doll of claim 1, wherein the doll is made from a solid material.

7. The doll of claim 1, wherein the doll is made from a plush material that includes filling material.

8. The doll of claim 1, wherein the first surface of the doll is a front exterior of the doll, and the second surface is a front interior of the doll.

9. The doll of claim 8, wherein the flexible cord attaches to an adjustment mechanism.

10. The doll of claim 9, wherein the adjustment mechanism is visible from a back exterior surface of the doll.

11. The doll of claim 1, wherein the flexible cord includes wire.

12. A method for manufacturing a doll, comprising:

Attaching an expression mechanism to a first surface of a doll, wherein the expression mechanism includes a flexible cord having an adjustable first length visible from the first surface, and wherein the flexible cord passes through two or more openings on the first surface of the doll and emerges through two or more openings on a second surface of the doll.

13. The method of claim 12, wherein the first surface of the doll is a front exterior of the doll, and the second surface of the doll is a back exterior of the doll.

14. The method of claim 12, wherein the facial expression mechanism represents a mouth.

15. The method of claim 12, wherein the facial expression mechanism represents an eyebrow.

16. The method of claim 12, wherein the first surface of the doll is a front exterior of the doll, and the second surface is a front interior of the doll.

17. The method of claim 16, wherein the flexible cord attaches to an adjustment mechanism.

18. The method of claim 17, wherein the adjustment mechanism is visible from a back exterior surface of the doll.

19. The method of claim 12, wherein the doll is made from a plush material that includes filling material.

20. The method of claim 12, wherein the doll is made from plastic or vinyl.

* * * * *